US010424430B2

(12) United States Patent
Nishide et al.

(10) Patent No.: US 10,424,430 B2
(45) Date of Patent: Sep. 24, 2019

(54) MODULE AND METHOD FOR MANUFACTURING THE MODULE

(71) Applicant: Murata Manufacturing Co., Ltd., Kyoto (JP)

(72) Inventors: Mitsuyoshi Nishide, Kyoto (JP); Yoshihito Otsubo, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 330 days.

(21) Appl. No.: 15/267,729

(22) Filed: Sep. 16, 2016

(65) Prior Publication Data

US 2017/0004914 A1 Jan. 5, 2017

Related U.S. Application Data

(63) Continuation of application No. PCT/JP2015/055642, filed on Feb. 26, 2015.

(30) Foreign Application Priority Data

Mar. 18, 2014 (JP) ..... 2014-054855

(51) Int. Cl.
*H01F 27/24* (2006.01)
*H01F 17/06* (2006.01)
(Continued)

(52) U.S. Cl.
CPC ..... *H01F 27/24* (2013.01); *H01F 17/0013* (2013.01); *H01F 17/06* (2013.01);
(Continued)

(58) Field of Classification Search
CPC ..... H01F 5/00; H01F 27/00–27/36
(Continued)

(56) References Cited

U.S. PATENT DOCUMENTS 7,821,374 B2 * 10/2010 Harrison ..... H01F 19/04 336/229
2006/0176139 A1 * 8/2006 Pleskach ..... H01F 17/0033 336/223
2009/0002111 A1 1/2009 Harrison et al.

FOREIGN PATENT DOCUMENTS

JP 2004-186637 A 7/2004
JP 2006-278841 A 10/2006
(Continued)

OTHER PUBLICATIONS

International Search Report issued in Japanese Patent Application No. PCT/JP2015/055642 dated May 12, 2015.
(Continued)

*Primary Examiner* — Tuyen T Nguyen
(74) *Attorney, Agent, or Firm* — Pearne & Gordon LLP

(57) ABSTRACT

A module includes an insulating layer, a ring-shaped magnetic core built in the insulating layer, a coil electrode disposed in the insulating layer so as to spirally wind around the magnetic core, and heat-dissipating metal bodies respectively disposed outside and inside the magnetic core within the insulating layer. Building the magnetic core into the insulating layer as described above eliminates the need to provide the principal face of the insulating layer with a large mounting area for mounting a coil formed by the magnetic core and the coil electrode. This allows the area of the principal face of the insulating layer to be reduced to achieve miniaturization of the module. The presence of the heat-dissipating metal bodies respectively disposed outside and inside the magnetic core within the insulating layer improves dissipation of the heat generated from the coil.

6 Claims, 4 Drawing Sheets

(51) Int. Cl.

| | |
|---|---|
| ***H01F 17/00*** | (2006.01) |
| ***H01F 27/22*** | (2006.01) |
| ***H01F 41/04*** | (2006.01) |
| ***H01F 27/28*** | (2006.01) |
| ***H01F 41/02*** | (2006.01) |

(52) U.S. Cl.
CPC ..... *H01F 27/22* (2013.01); *H01F 27/2804* (2013.01); *H01F 27/2876* (2013.01); *H01F 41/02* (2013.01); *H01F 41/046* (2013.01)

(58) Field of Classification Search
USPC ..... 336/55–623
See application file for complete search history.

(56) References Cited

FOREIGN PATENT DOCUMENTS

| | | | | |
|---|---|---|---|---|
| JP | 2008-177516 | A | | 7/2008 |
| JP | 2010-516056 | A | | 5/2010 |
| JP | 2011-243870 | A | | 12/2011 |
| JP | 2012169463 | A | * | 9/2012 |

OTHER PUBLICATIONS

Written Opinion issued in Japanese Patent Application No. PCT/JP2015/055642 dated May 12, 2015.
Notice of Reasons for Rejection issued in Japanese Patent Application No. 2016-508639 dated Jun. 20, 2017.

* cited by examiner

-- PRIOR ART --

MODULE AND METHOD FOR MANUFACTURING THE MODULE

This is a continuation of International Application No. PCT/JP2015/055642 filed on Feb. 26, 2015 which claims priority from Japanese Patent Application No. 2014-054855 filed on Mar. 18, 2014. The contents of these applications are incorporated herein by reference in their entireties.

FIELD OF THE DISCLOSURE

The present disclosure relates to a module with a coil core embedded in an insulating layer, and a method for manufacturing the module.

DESCRIPTION OF THE RELATED ART

Some modules designed for high frequency signals have, as a component to prevent noise, a toroidal coil mounted on a wiring board. For example, as illustrated in FIG. 6, a module 100 described in Patent Document 1 includes a wiring board 101 made of insulating resin, and an annular magnetic core 102 mounted on the upper face of the wiring board 101. A coil electrode that spirally winds around the magnetic core 102 is formed by a plurality of wiring electrode patterns 103 formed on the wiring board 101, and a plurality of jumpers 104 each formed by a flat wire bent in a U-shape and disposed so as to straddle the magnetic core 102. In the module 100, a heat-dissipating board 105 is secured onto the lower face of the wiring board 101 to release the heat generated from the coil to the outside of the module 100.

Patent Document 1: Japanese Unexamined Patent Application Publication No. 2006-278841 (see paragraphs 0010 to 0014, FIG. 1, etc.)

BRIEF SUMMARY OF THE DISCLOSURE

The core formed by the magnetic core 102 and the coil electrode is physically large relative to other electronic components mounted on the upper face of the wiring board 101. The upper face of the wiring board 101 thus needs to be provided with a large area for mounting the coil. This requirement places a limit to the miniaturization of the module 100 through reduction of the area of the principal face of the wiring board 101. Although miniaturization of the module 100 would be achieved by building the coil into the wiring board 101, if the wiring board 101 is made of resin, it is possible that the heat generated from the coil builds up within the resin, leading to the degradation of the coil characteristics.

The present disclosure has been made in view of the above-mentioned problems, and accordingly it is an object of the disclosure to achieve miniaturization of a module by building a coil into the module, while also achieving the improved dissipation of the heat generated from the coil.

To achieve the above object, a module according to the present disclosure includes an insulating layer, a ring-shaped coil core embedded in the insulating layer, a coil electrode disposed in the insulating layer so as to wind around the coil core, and a heat-dissipating member disposed outside the coil core within the insulating layer.

Building the coil core into the insulating layer as described above eliminates the need to provide the principal face of the insulating layer with a large mounting area for mounting a coil formed by the coil core and the coil electrode. This allows the area of the principal face of the insulating layer to be reduced to achieve miniaturization of the module.

Further, for example, if the heat-dissipating member is made of metal, the metal has a thermal conductivity higher than that of a material such as ceramic or resin commonly used to form the insulating layer, and thus the presence of the heat-dissipating member made of metal and disposed outside the coil core within the insulating layer improves the dissipation of the heat generated from the coil.

If the heat-dissipating member is made of metal, contact of the heat-dissipating member with the coil electrode may lead to the degradation of the coil characteristics. Even if the heat-dissipating member and the coil electrode do not contact each other, when the two components are located in close proximity to each other, this may cause an eddy current to be generated in that location, leading to the degradation of the coil characteristics. Accordingly, if an insulator with a thermal conductivity higher than that of the insulating layer is used to form the heat-dissipating member, this makes it possible to prevent the degradation of the coil characteristics even when the heat-dissipating member and the coil electrode are placed in contact with or in close proximity to each other.

Disposing the heat-dissipating member made of metal outside the coil core has the following effect. For example, if stress is exerted on the coil core from outside the module, such as when the module is dropped, the heat-dissipating member also acts as a component that mitigates this stress, thus preventing the breakage of the coil core due to external stress.

The heat-dissipating member may be further disposed inside the coil core within the insulating layer. This configuration allows the heat generated from the coil to be dissipated by the heat-dissipating members disposed both outside and inside the coil core, thus further improving the heat dissipation characteristics of the module.

The coil electrode may include a plurality of outer metal pins disposed so as to cross the circumferential direction of the coil core, the outer metal pins being arranged along the outer circumferential face of the coil core, a plurality of inner metal pins disposed so as to cross the circumferential direction of the coil core, the inner metal pins being arranged along the inner circumferential face of the coil core such that the inner metal pins form a plurality of pairs with the corresponding ones of the outer metal pins, a plurality of first connecting members that each connect one end face of one of the outer metal pins with one end face of one of the inner metal pins that forms a pair with the outer metal pin, and a plurality of second connecting members that each connect another end face of one of the outer metal pins, with another end face of one of the inner metal pins located adjacent to and on a predetermined side of one of the inner metal pins that forms a pair with the outer metal pin.

The outer metal pins and the inner metal pins have a low resistivity in comparison to conductors formed by providing through-holes in the insulating layer, such as via conductors and through-hole conductors. Consequently, when each conductor connecting a predetermined one of the first connecting members with the corresponding second connecting member is formed by the outer metal pin or the inner metal pin, the overall resistance of the coil electrode can be reduced, thus improving the characteristics of the coil included in the module.

Use of conductors formed by providing through-holes in the insulating layer, such as via conductors and through-hole conductors, places a limit to the narrowing of the pitch between adjacent conductors. By contrast, use of the outer metal pins and the inner metal pins, which are formed without providing such through-holes, facilitates the narrowing of the pitch between adjacent metal pins. The pitch between adjacent metal pins can be thus easily narrowed to increase the number of turns in the coil electrode. This makes it possible to provide a module with a high-inductance coil embedded in the module, within the limited space in the interior of the insulating layer.

The outer metal pins, the inner metal pins, and the heat-dissipating member may be each made of the same metal. This allows the outer metal pins, the inner metal pins, and the heat-dissipating member to be formed simultaneously.

The outer metal pins, the inner metal pins, and the heat-dissipating member may be each made of different metals. This configuration allows, for example, the heat-dissipating member to be made of a metal with superior heat dissipation characteristics, while allowing the outer metal pins and the inner metal pins to be each made of a metal that is highly rigid and not prone to breakage.

A method for manufacturing a module according to the present disclosure includes the steps of preparing a metal plate, the metal plate being stuck on one principal face of a support having a flat shape, etching the metal plate to simultaneously form a plurality of outer metal pins disposed upright on one principal face of the support and arranged in a ring shape, a plurality of inner metal pins located inside the outer metal pins with a placement space for placing a coil core being interposed between the inner metal pins and the outer metal pins, the inner metal pins being disposed upright on the one principal face of the support and arranged in a ring shape to form a plurality of pairs with corresponding ones of the outer metal pins, and a metal body serving as a heat-dissipating member, the metal body being disposed in, out of an area located outside the outer metal pins and an area located inside the inner metal pins, at least the area located outside the outer metal pins, placing the coil core in the placement space, forming an insulating layer that seals the one principal face of the support, the coil core, the outer metal pins, the inner metal pins, and the metal body, performing polishing or grinding to remove the support, and expose both end faces of the outer metal pins and both end faces of the inner metal pins from the insulating layer, and forming a plurality of first connecting members that each connect one end face of one of the outer metal pins with one end face of one of the inner metal pins that forms a pair with the outer metal pin, and a plurality of second connecting members that each connect another end face of one of the outer metal pins with another end face of one of the inner metal pins located adjacent to and on a predetermined side of one of the inner metal pins that forms a pair with the outer metal pin.

In this case, etching, which is a common technique, can be used to form the following components disposed within the insulating layer: the outer metal pins and the inner metal pins, and the metal body serving as a heat-dissipating member that is located in, out of an area outside the outer metal pins and an area inside the inner metal pins, at least the area outside the outer metal pins. This allows for easy manufacture of a module that is capable of being miniaturized by building a coil core into the module, while achieving the improved dissipation of the heat generated from the coil.

Further, the outer metal pins, the inner metal pins, and the metal body that serves as a heat-dissipating member can be formed simultaneously by etching, thus enabling the inexpensive manufacture of a module that is compact with superior heat dissipation characteristics.

According to the present disclosure, the magnetic core is embedded in the insulating layer, thus eliminating the need to provide the principal face of the insulating layer with a large mounting area for mounting a coil formed by the coil core and the coil electrode. This allows the area of the principal face of the insulating layer to be reduced to achieve miniaturization of the module. Further, for example, if the heat-dissipating member is made of metal, the metal has a thermal conductivity higher than that of a material such as ceramic or resin commonly used to form the insulating layer, and thus the presence of the heat-dissipating member made of metal and disposed outside the coil core within the insulating layer improves dissipation of the heat generated from the coil.

DETAILED DESCRIPTION OF THE DISCLOSURE

Figure 1:
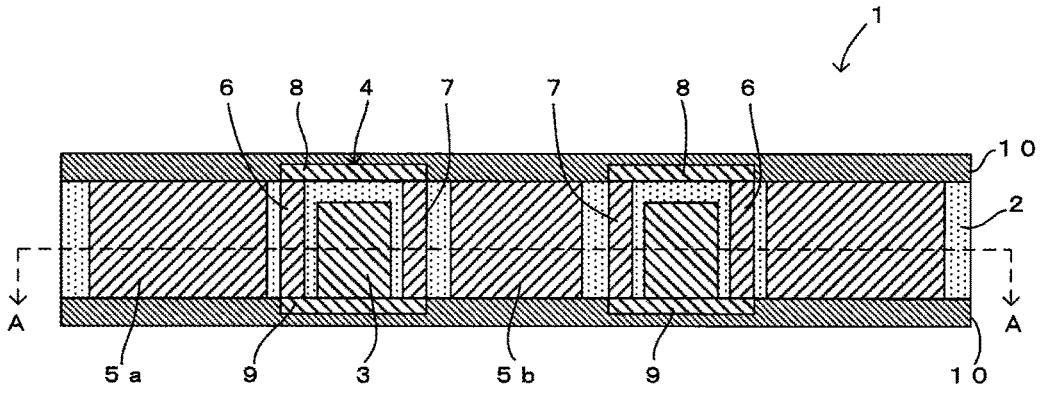
FIG. 1 is a cross-sectional view of a module according to an embodiment of the present disclosure.
Figure 2:
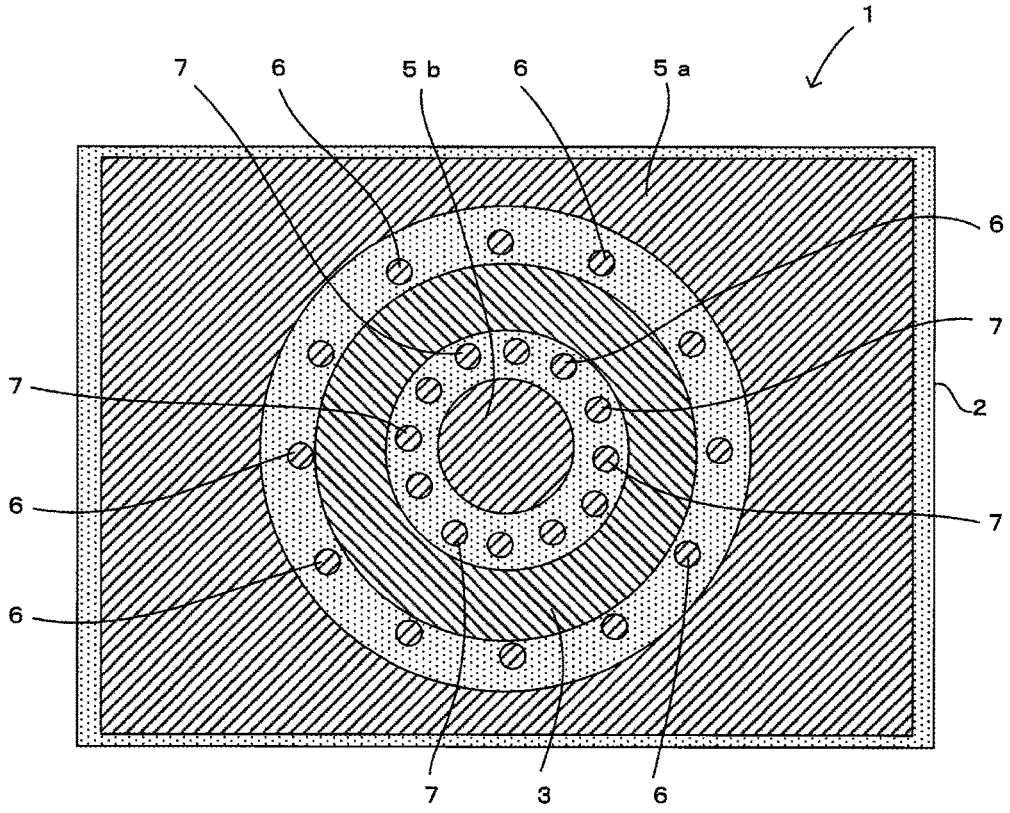
FIG. 2 is a cross-sectional view taken along an arrow A-A in FIG. 1.
Figure 3:
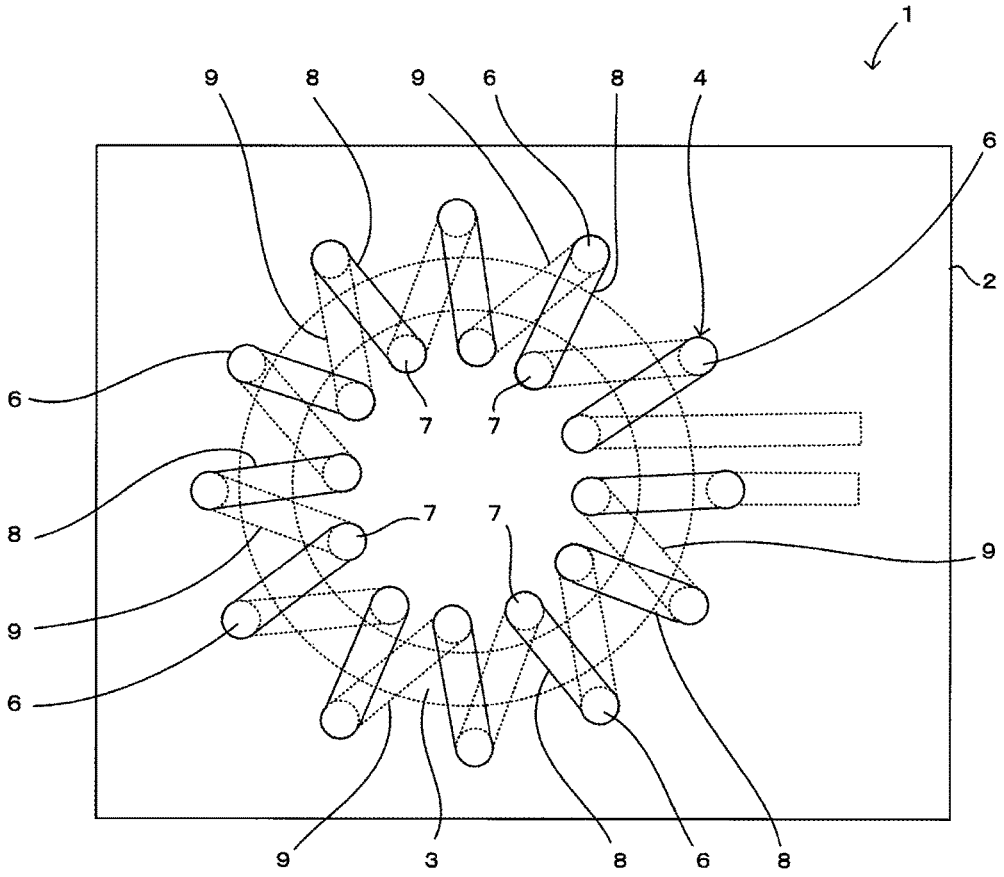
FIG. 3 is a plan view of the module illustrated in FIG. 1.

A module 1 according to an embodiment of the present disclosure will be described with reference to FIGS. 1 to 3. FIG. 1 is a cross-sectional view of the module 1. FIG. 2 is a cross-sectional view taken along an arrow A-A in FIG. 1. FIG. 3 is a plan view of the module 1, illustrating a coil electrode 4 provided in the module 1. FIG. 3 illustrates only features necessary for explaining the coil electrode 4, and does not illustrate other features.

As illustrated in FIG. 1, the module 1 according to the embodiment includes an insulating layer 2, a ring-shaped magnetic core 3 (corresponding to "coil core" according to the present disclosure) provided in the insulating layer 2, the coil electrode 4 disposed in the insulating layer 2 so as to spirally wind around the magnetic core 3, and heat-dissipating metal bodies 5*a* and 5*b* (each corresponding to "heat-dissipating member" according to the present disclosure) respectively disposed outside and inside the magnetic core 3 within the insulating layer 2.

The insulating layer 2 is made of, for example, thermosetting resin such as epoxy resin. The insulating layer 2 is formed so as to cover the magnetic core 3, the metal bodies 5*a* and 5*b*, and outer metal pins 6 and inner metal pins 7 that will be described later.

The magnetic core 3 is a so-called toroidal core formed in a ring shape. The magnetic core 3 is made of, for example, a magnetic material commonly used for a coil core, such as ferrite.

The coil electrode 4 is spirally wound around the ring-shaped magnetic core 3. The coil electrode 4 includes a plurality of outer metal pins 6 disposed on the outer circumferential side of the magnetic core 3, a plurality of inner metal pins 7 disposed on the inner circumferential side of the magnetic core 3, a plurality of upper wiring electrodes 8 (corresponding to "first connecting members" according to the present disclosure) disposed on one principal face (upper face) of the insulating layer 2, and a plurality of lower wiring electrodes 9 (corresponding to "second connecting members" according to the present disclosure) disposed on the other principal face (lower face) of the insulating layer 2.

As illustrated in FIGS. 1 and 2, the outer metal pins 6 are disposed so as to cross the circumferential direction of the magnetic core 3, and arranged along the outer circumferential face of the magnetic core 3. The inner metal pins 7 are disposed so as to cross the circumferential direction of the magnetic core 3, and arranged along the inner circumferential direction of the magnetic core 3. The inner and outer metal pins 6 and 7 are both exposed to the upper face of the insulating layer 2 at their upper end face, and exposed to the lower face of the insulating layer 2 at their lower end face. The outer and inner metal pins 6 and 7 are each made of a metallic material commonly used for wiring electrodes, such as Cu, Au, Ag, or Al, or a Cu-based alloy. When Cu—Fe or Cu—Ni, which is higher in rigidity than Cu, is used as the material of the metal pins 6 and 7 as a Cu-based alloy, this reduces the risk of the metal pins 6 and 7 breaking or bending when the metal pins 6 and 7 are formed narrow, thus preventing the metal pins 6 and 7 from toppling over and coming into contact with each other during, for example, the manufacturing process of the module 1. The surfaces of the metal pins 6 and 7 may be subjected to treatment such as rust-proofing or insulating coating. Applying rust-proofing to the metal pins 6 and 7 makes it possible to prevent the metal pins 6 and 7 from oxidizing and thus degrading in terms of strength and electrical characteristics. Applying insulating coating makes it possible to prevent the degradation of the coil characteristics that occurs when adjacent metal pins 6 and 7 are placed in contact with each other. This allows the number of turns in the coil electrode 4 to be readily increased. The metal pins 6 and 7 can be formed by processes such as shearing of a wire rod made of the metallic material mentioned above.

The inner metal pins 7 are disposed so as to form a plurality of pairs with the corresponding outer metal pins 6. As illustrated in FIG. 3, the upper wiring electrode 8 connects one end faces (upper end faces) of the outer metal pin 6 and the inner metal pin 7 that form a pair with each other. Further, each of the lower wiring electrodes 9 connects the other end face (lower end face) of the outer metal pin 6, with the other end face of the inner metal pin 7 located adjacent to and on a predetermined side (on the counterclockwise side in FIG. 3) of the inner metal pin 7 that forms a pair with the above-mentioned outer metal pin 6. As illustrated in FIG. 3, in plan view, each of the upper wiring electrodes 8 is arranged on the upper face of the insulating layer 2 in the direction of the winding axis of the coil electrode 4 (the direction of the lines of magnetic flux generated when the coil electrode 4 is energized), with one end of the upper wiring electrode 8 being located inside the magnetic core 3 and the other end being located outside the magnetic core 3. Each of the lower wiring electrodes 9 is arranged on the lower face of the insulating layer 2 in the direction of the winding axis of the coil electrode 4, with one end of the lower wiring electrode 9 being located inside the magnetic core 3 and the other end being located outside the magnetic core 3. Each of the wiring electrodes 8 and 9 can be formed by, for example, an electrically conductive paste containing a metal such as Ag or Cu. With the outer and inner metal pins 6 and 7 connected to the wiring electrodes 8 and 9 in this way, the coil electrode 4 that spirally winds around the ring-shaped magnetic core 3 is provided in the insulating layer 2. Each of the wiring electrodes 8 and 9 may be formed by forming an electrode plated with a metal such as Cu on an underlying electrode made from an electrically conductive paste of a metal such as Ag or Cu. This configuration allows the wiring resistances of the wiring electrodes 8 and 9 to be reduced, leading to improved coil characteristics.

A covering resin layer 10 is stacked on each principal face of the insulating layer 2 so as to cover the upper wiring electrodes 8 and the lower wiring electrodes 9. The covering resin layer 10 is made of, for example, the same resin as the resin used to form the insulating layer 2, such as thermosetting resin. Alternatively, instead of the covering resin layer 10, a wiring board with a ground electrode may be used to connect the ground electrode with the heat-dissipating metal bodies 5*a* and 5*b*. This configuration further improves the dissipation of heat by the metal bodies 5*a* and 5*b*.

The heat-dissipating metal bodies 5*a* and 5*b* are each made of a metal such as Cu or Al, and disposed within the insulating layer 2. Specifically, as illustrated in FIG. 2, the metal body 5*a* is disposed outside the magnetic core 3 within the insulating layer 2, more specifically, outside the outer metal pins 6 within the insulating layer 2 in such a way as to surround the outer metal pins 6. Further, the other metal body 5*b* is disposed inside the magnetic core 3, more specifically, inside the inner metal pins 7 within the insulating layer 2. The metal body 5*a* disposed outside the outer metal pins 6 may not necessarily be provided so as to surround the outer metal pins 6. As long as the metal body 5*a* is located outside the outer metal pins 6 within the insulating layer 2, the shape of the metal body 5*a*, the area where the metal body 5*a* is to be disposed, and the number of the metal bodies 5*a* disposed may be changed as appropriate. The metal body 5*b* disposed inside the inner metal pins 7 within the insulating layer 2 may not necessarily be provided.

Instead of the metal bodies 5*a* and 5*b*, for example, an insulator with a thermal conductivity higher than that of the insulating layer 2, such as aluminum nitride or silicon nitride, may be used to form the heat-dissipating member.

(Method for Manufacturing Module 1)

Next, a method for manufacturing the module 1 will be described with reference to FIGS. 4A to 4E and FIGS. 5A and 5B by citing, by way of example, a case in which the metal pins 6 and 7, and the heat-dissipating metal bodies 5*a* and 5*b* are each made of the same metal, Cu. FIGS. 4A to 4E and FIGS. 5A and 5B each illustrate a method for manufacturing the module 1, of which FIG. 4A to FIG. 4E illustrate individual steps of the manufacturing method, and FIG. 5A and FIG. 5B illustrate the steps subsequent to the step illustrated in FIG. 4E.

Figure 4A:
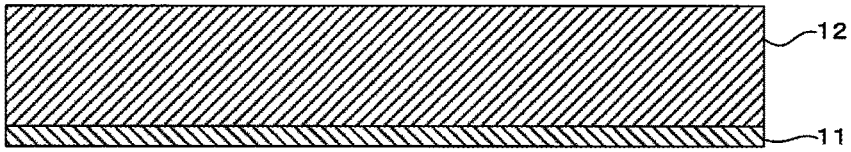
FIGS. 4A to 4E illustrate a method for manufacturing the module illustrated in FIG. 1.
Figure 5A:
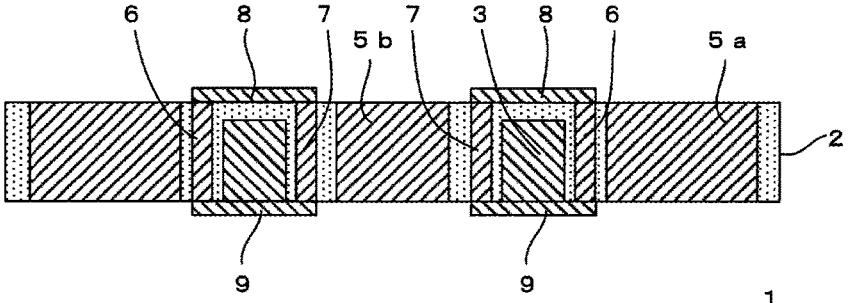
FIGS. 5A and 5B illustrate a method for manufacturing the module illustrated in FIG. 1.
Figure 5B:
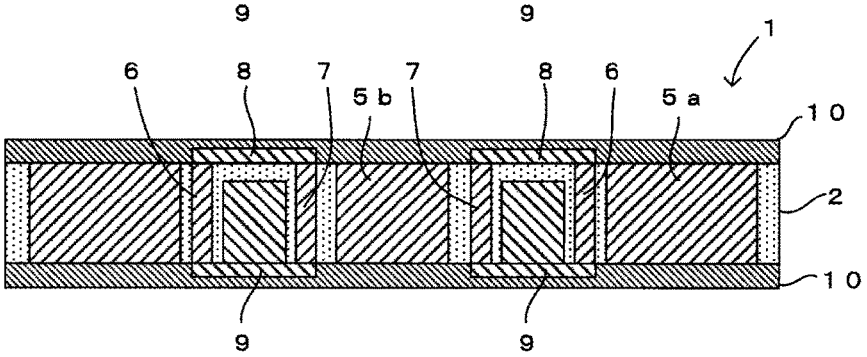
Figure 6:
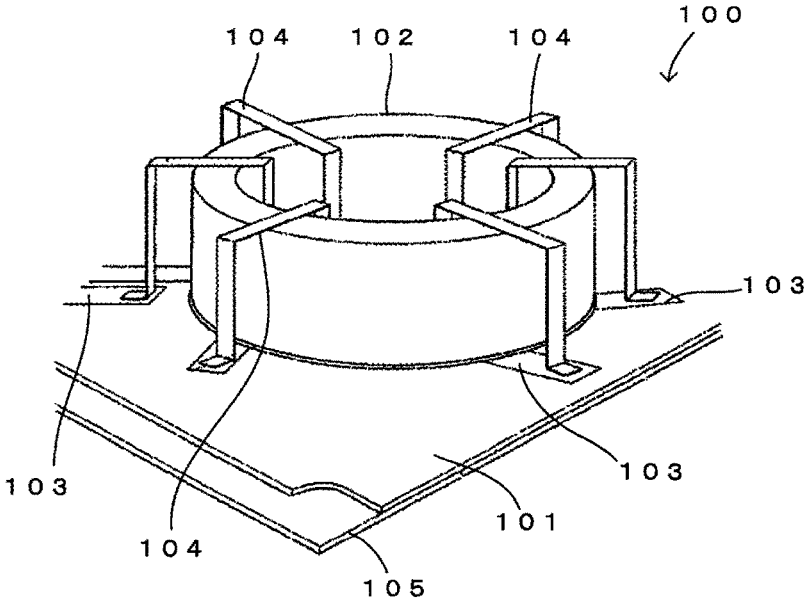
FIG. 6 is a perspective view of a part of a module according to related art.

First, a metal plate 12 made of Cu with a predetermined thickness is prepared as illustrated in FIG. 4A. The metal plate 12 is stuck onto a flat-shaped support 11 made of a material such as resin.

Figure 4B:
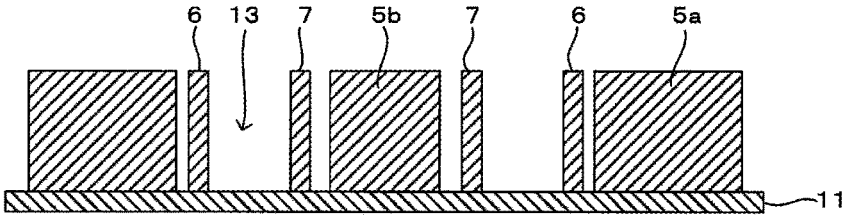

Next, as illustrated in FIG. 4B, the metal plate 12 is etched to simultaneously form the outer metal pins 6, the inner metal pins 7, and the heat-dissipating metal bodies 5*a* and 5*b*. Specifically, this process simultaneously forms the outer metal pins 6 disposed upright on one principal face of the support 11 and arranged in, for example, an annular shape, the inner metal pins 7 located inside the outer metal pins with a placement space 13 for placing the magnetic core 3 being interposed between the inner metal pins 7 and the outer metal pins 6, the inner metal pins 7 being disposed upright on the one principal face of the support 11 and arranged in, for example, an annular shape to form a plurality of pairs with the corresponding outer metal pins 6, and the heat-dissipating metal bodies 5*a* or 5*b* disposed respectively outside the outer metal pins 6 and inside the inner metal pins 7. The placement space 13 for placing the magnetic core 3 is created by removing the portion of the metal between the outer metal pins 6 and the inner metal pins 7 of the metal plate 12 by etching. In the case of a configuration in which the metal body 5*b* is not disposed inside the inner metal pins 7, the metal located in the area surrounded by the inner metal pins 7 of the metal plate 12 may be removed by etching. Each of the outer metal pins 6 and the inner metal pins 7 may be formed in any ring shape, such as a square or triangular ring.

Figure 4C:
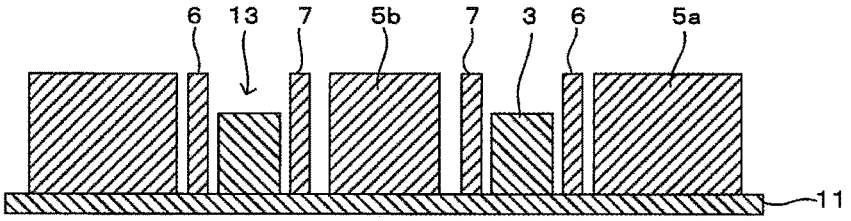

Next, as illustrated in FIG. 4C, the magnetic core 3 having a ring shape is placed in the placement space 13, which is created by etching the metal plate 12 and in which the magnetic core 3 is to be placed.

Figure 4D:
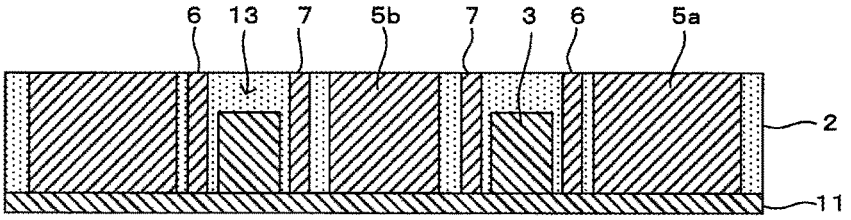

Next, as illustrated in FIG. 4D, the insulating layer 2 is formed. The insulating layer 2 seals the one principal face of the support 11, the magnetic core 3, the metal pins 6 and 7, and the metal bodies 5*a* and 5*b*. The insulating layer 2 is made of, for example, thermosetting resin such as epoxy resin. The insulating layer 2 can be formed by methods such as coating, printing, compression molding, and transfer molding.

Figure 4E:
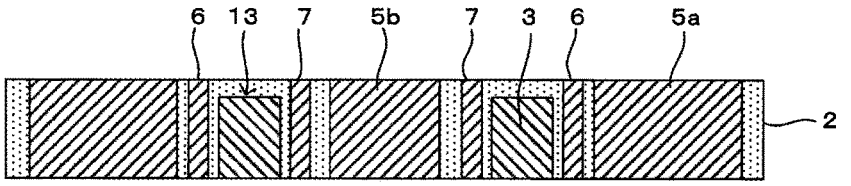

Next, as illustrated in FIG. 4E, both principal faces of the insulating layer 2 are polished or ground to remove the support 11, and expose both end faces of the metal pins 6 and both end faces of the metal pins 7 from the insulating layer 2. At this time, the lower face of the magnetic core 3 may be exposed from the lower face of the insulating layer 2.

Next, as illustrated in FIG. 5A, the upper wiring electrodes 8 and the lower wiring electrodes 9 are formed on the lower face of the insulating layer 2. Each of the upper wiring electrodes 8 connects the upper end face of the outer metal pin 6 with the upper end face of the inner metal pin 7 that forms a pair with the outer metal pin 6. Each of the lower wiring electrodes 9 connects the lower end face of the outer metal pin 6, with the lower end face of the inner metal pin 7 located adjacent to and on a predetermined side (on the counterclockwise side in FIG. 3) of the inner metal pin 7 that forms a pair with the above-mentioned outer metal pin 6. The wiring electrodes 8 and 9 can be formed by, for example, a method such as screen printing using an electrically conductive paste containing a metal such as Ag or Cu.

Lastly, as illustrated in FIG. 5B, the covering resin layer 10 is stacked on each of the upper and lower faces of the insulating layer 2 so as to cover the wiring electrodes 8 and 9, thus completing the module 1. The covering resin layer 10 may be formed by a method such as screen printing using a thermosetting resin such as epoxy resin. The covering resin layer 10 may not necessarily be provided, or the covering resin layer 10 may be provided only on one of the upper and lower faces of the insulating layer 2. This is because, although disposing the covering resin layer 10 makes it possible to prevent, for example, corrosion of the wiring electrodes 8 and 9 due to moisture, it is not always necessary to provide the covering resin layer 10 if the wiring electrodes 8 and 9 are made of a metal with superior corrosion resistance, such as Au.

In the above-mentioned embodiment, the magnetic core 3 is thus embedded in the insulating layer 2. This eliminates the need to provide the principal face of the insulating layer 2 with a large mounting area for mounting a coil formed by the magnetic core 3 and the coil electrode 4. This allows the area of the principal face of the insulating layer 2 to be reduced to achieve miniaturization of the module 1.

The metal forming the heat-dissipating metal bodies 5*a* and 5*b* has a thermal conductivity higher than that of the resin forming the insulating layer 2. Consequently, the presence of the heat-dissipating metal body 5*a* disposed outside the magnetic core 3 within the insulating layer 2 improves dissipation of the heat generated from the coil. Since the heat-dissipating metal body 5*b* is also disposed inside the magnetic core 3 within the insulating layer 2, dissipation of the heat generated from the coil is further improved.

Disposing the metal body 5*a* outside the magnetic core 3 has the following effect. For example, if stress is exerted on the magnetic core 3 from outside the module 1, such as when the module 1 is dropped, the metal body 5*a* also acts as a component that mitigates this stress, thus preventing breakage of the magnetic core 3 due to external stress.

If the heat-dissipating member is made of metal (the metal body 5*a* or 5*b*), contact of the metal body 5*a* or 5*b* with the coil electrode 4 may lead to the degradation of the coil characteristics. Even if the metal body 5*a* or 5*b* and the coil electrode 4 do not contact with each other, when the two components are located in close proximity to each other, this may cause an eddy current to be generated in that location, leading to the degradation of the coil characteristics. Accordingly, if an insulator such as aluminum nitride or silicon nitride instead of the metal body 5*a* or 5*b* is used to form the heat-dissipating member, this makes it possible to prevent the degradation of the coil characteristics even when the heat-dissipating member and the coil electrode 4 are placed in contact with or in close proximity to each other.

The outer metal pins 6 and the inner metal pins 7 have a low resistivity in comparison to conductors formed by providing through-holes in the insulating layer 2, such as via conductors and through-hole conductors. Consequently, when each conductor connecting a predetermined one of the upper wiring electrodes 8 with the corresponding lower wiring electrode 9 is formed by the outer metal pin 6 or the inner metal pin 7, the overall resistance of the coil electrode 4 can be reduced, thus improving the characteristics of the coil included in the module 1.

Use of conductors formed by providing through-holes in the insulating layer 2, such as via conductors and through-hole conductors, places a limit to the narrowing of the pitch between adjacent conductors. By contrast, use of the outer metal pins 6 and the inner metal pins 7, which are formed without providing such through-holes, facilitates the narrowing of the pitch between the metal pins 6 and 7 that are adjacent to each other. The pitch between the adjacent metal pins 6 and 7 can be thus easily narrowed to increase the number of turns in the coil electrode 4. This makes it possible to provide the module 1 with a high-inductance coil embedded in the module 1, within the limited space in the interior of the insulating layer 2.

Forming each of the metal pins 6 and 7 and the heat-dissipating metal bodies 5*a* and 5*b* by the same metal allows the metal pins 6 and 7 and the metal bodies 5*a* and 5*b* to be formed simultaneously.

With the method for manufacturing the module 1 according to this embodiment, etching, which is a common technique, can be used to form the following components disposed within the insulating layer 2: the metal pins 6 and 7, the heat-dissipating metal body 5*a* disposed outside the outer metal pins 6, and the heat-dissipating metal body 5*b* disposed inside the inner metal pins 7. This allows for easy manufacture of the module 1 that is capable of being miniaturized by building the magnetic core 3 into the module 1, while achieving the improved dissipation of the heat generated from the coil.

Further, the outer metal pins 6, the inner metal pins 7, and the heat-dissipating metal bodies 5*a* and 5*b* can be formed simultaneously by etching, thus enabling the inexpensive manufacture of the module 1 that is compact with superior heat dissipation characteristics.

The present disclosure is not limited to each embodiment mentioned above but may be modified in various forms other than those mentioned above, without departing from the scope of the disclosure. For example, although the above-mentioned embodiment is directed to a method for manufacturing the module 1 in which each of the metal pins 6 and 7 and the heat-dissipating metal bodies 5*a* and 5*b* are made of the same metal, if each of the metal pins 6 and 7 and the metal bodies 5*a* and 5*b* are to be made of different metals, the manufacturing method may be modified such that, during the etching of the metal plate 12 described above with reference to FIG. 4B, the metal is allowed to remain only in the portion of the metal plate 12 where the metal bodies 5*a* and 5*b* are to be placed, and then the metal pins 6 and 7 that are individually prepared are mounted onto one principal face of the support 11 later. The manufacturing method may be also modified such that the metal bodies 5*a* and 5*b* are prepared in advance by cutting a material such as a metal block into a desired shape, and then the metal bodies 5*a* and 5*b* thus prepared are disposed on the support 11 in the same manner as the metal pins 6 and 7.

The coil to be embedded in the module 1 may not necessarily be a toroidal coil.

The present disclosure can be applied to various modules with a coil core embedded in the insulating layer.

1 module
2 insulating layer
3 magnetic core (coil core)
4 coil electrode
5*a*, 5*b* metal body (heat-dissipating member)
6 outer metal pin
7 inner metal pin
8 upper wiring electrode (first connecting member)
9 lower wiring electrode (second connecting member)

The invention claimed is:

1. A module comprising:
an insulating layer;
a ring-shaped coil core embedded in the insulating layer;
a coil electrode disposed in the insulating layer so as to wind around the coil core; and
a heat-dissipating member disposed within the insulating layer and radially aligned with the coil core such that a first portion of the heat-dissipating member is positioned adjacent an outer surface of the coil core that faces away from a radial center of the coil core.

2. The module according to claim 1, wherein the heat-dissipating member further includes a second portion that is disposed adjacent an inner surface of the coil core that faces towards the radial center of the coil core.

3. The module according to claim 1,
wherein the coil electrode includes
a plurality of outer metal pins disposed so as to cross a circumferential direction of the coil core, the outer metal pins being arranged along an outer circumferential face of the coil core,
a plurality of inner metal pins disposed so as to cross the circumferential direction of the coil core, the inner metal pins being arranged along an inner circumferential face of the coil core such that the inner metal pins form a plurality of pairs with corresponding ones of the outer metal pins,
a plurality of first connecting members each connecting one end face of each one of the outer metal pins with one end face of each one of the inner metal pins forming a pair with each one of the outer metal pins, and
a plurality of second connecting members each connecting another end face of each one of the outer metal pins with another end face of each one of the inner metal pins located adjacent to and on a predetermined side of each one of the inner metal pins forming a pair with each one of the outer metal pins.

4. The module according to claim 3, wherein the outer metal pins, the inner metal pins, and the heat-dissipating member are each made of same metal.

5. The module according to claim 3, wherein the outer metal pins, the inner metal pins, and the heat-dissipating member are each made of different metals.

6. The module according to claim 2,
wherein the coil electrode includes
a plurality of outer metal pins disposed so as to cross a circumferential direction of the coil core, the outer metal pins being arranged along an outer circumferential face of the coil core,
a plurality of inner metal pins disposed so as to cross the circumferential direction of the coil core, the inner metal pins being arranged along an inner circumferential face of the coil core such that the inner metal pins form a plurality of pairs with corresponding ones of the outer metal pins,
a plurality of first connecting members each connecting one end face of each one of the outer metal pins with one end face of each one of the inner metal pins forming a pair with each one of the outer metal pins, and
a plurality of second connecting members each connecting another end face of each one of the outer metal pins with another end face of each one of the inner metal pins located adjacent to and on a predetermined side of each one of the inner metal pins forming a pair with each one of the outer metal pins.

* * * * *